US009761371B2

(12) United States Patent
Park et al.

(10) Patent No.: US 9,761,371 B2
(45) Date of Patent: Sep. 12, 2017

(54) COIL TYPE UNIT FOR WIRELESS POWER TRANSMISSION, WIRELESS POWER TRANSMISSION DEVICE, ELECTRONIC DEVICE AND MANUFACTURING METHOD OF COIL TYPE UNIT FOR WIRELESS POWER TRANSMISSION

(71) Applicant: SAMSUNG ELECTRO-MECHANICS CO., LTD., Suwon-Si, Gyeonggi-Do (KR)

(72) Inventors: No Il Park, Suwon-Si (JP); Jang Su Kim, Suwon-Si (JP); Doo Sung Jung, Suwon-Si (JP); Seung Wook Park, Suwon-Si (JP)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 50 days.

(21) Appl. No.: 14/331,950

(22) Filed: Jul. 15, 2014

(65) Prior Publication Data

US 2015/0028686 A1 Jan. 29, 2015

(30) Foreign Application Priority Data

Jul. 23, 2013 (KR) ..... 10-2013-0086801

(51) Int. Cl.
*H01F 5/00* (2006.01)
*H01F 38/14* (2006.01)
(Continued)

(52) U.S. Cl.
CPC ..... *H01F 38/14* (2013.01); *H01F 5/00* (2013.01); *H01F 27/2804* (2013.01);
(Continued)

(58) Field of Classification Search
CPC ..... H01F 5/00; H01F 27/00–27/30
(Continued)

(56) References Cited

U.S. PATENT DOCUMENTS 9,466,994 B2 * 10/2016 Yamazaki ..... H04B 5/0037
2013/0342193 A1 * 12/2013 Yoo ..... H01F 5/003 324/228
2014/0265612 A1 * 9/2014 Choi ..... H01F 27/365 307/104

FOREIGN PATENT DOCUMENTS

KR 10-2012-0008200 A 1/2012

* cited by examiner

*Primary Examiner* — Tuyen Nguyen
(74) *Attorney, Agent, or Firm* — McDermott Will & Emery LLP

(57) ABSTRACT

The present invention relates to a coil type unit for wireless power transmission, a wireless power transmission device, an electronic device, and a manufacturing method of a coil type unit for wireless power transmission. A coil type unit for wireless power transmission according to the present invention includes a coil pattern in the form of a wiring pattern; a magnetic portion having the coil pattern attached to one surface thereof; and an adhesive portion interposed between the magnetic portion and the coil pattern to bond the magnetic portion and the coil pattern, wherein the magnetic portion is formed by laminating one or more conductive sheets with one or more magnetic sheets and integrally firing the laminated sheets, and the magnetic portion has conductive holes in the position, where both ends of the coil pattern are disposed, to electrically connect the both ends of the coil pattern and the conductive sheet.

5 Claims, 19 Drawing Sheets

(51) Int. Cl.
*H01F 27/28* (2006.01)
*H01F 1/34* (2006.01)

(52) U.S. Cl.
CPC ..... *H01F 1/344* (2013.01); *H01F 2027/2809* (2013.01); *Y10T 29/49073* (2015.01)

(58) Field of Classification Search
USPC ..... 336/65, 83, 84 C, 84 R, 84 M, 200, 232
See application file for complete search history.

[FIG. 1]
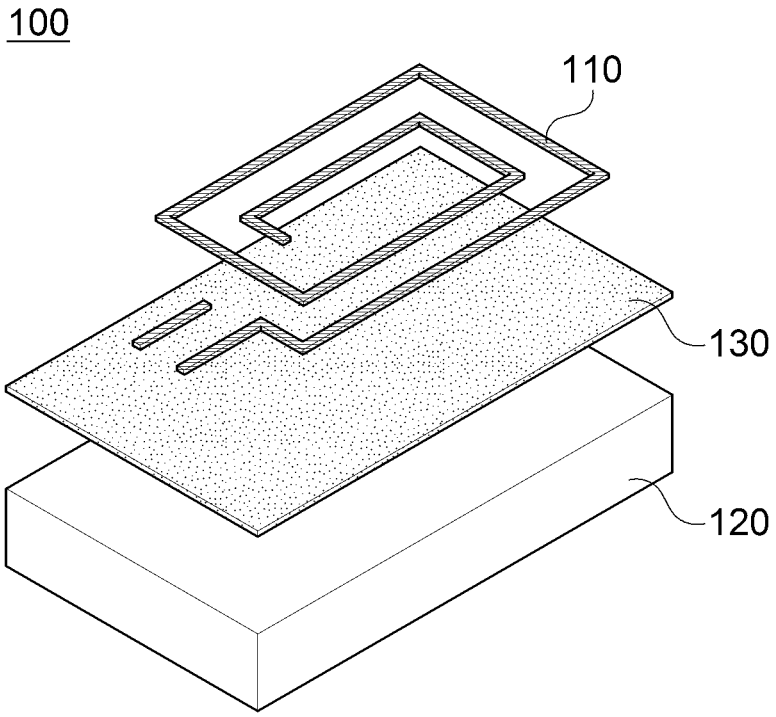

[FIG. 2A]
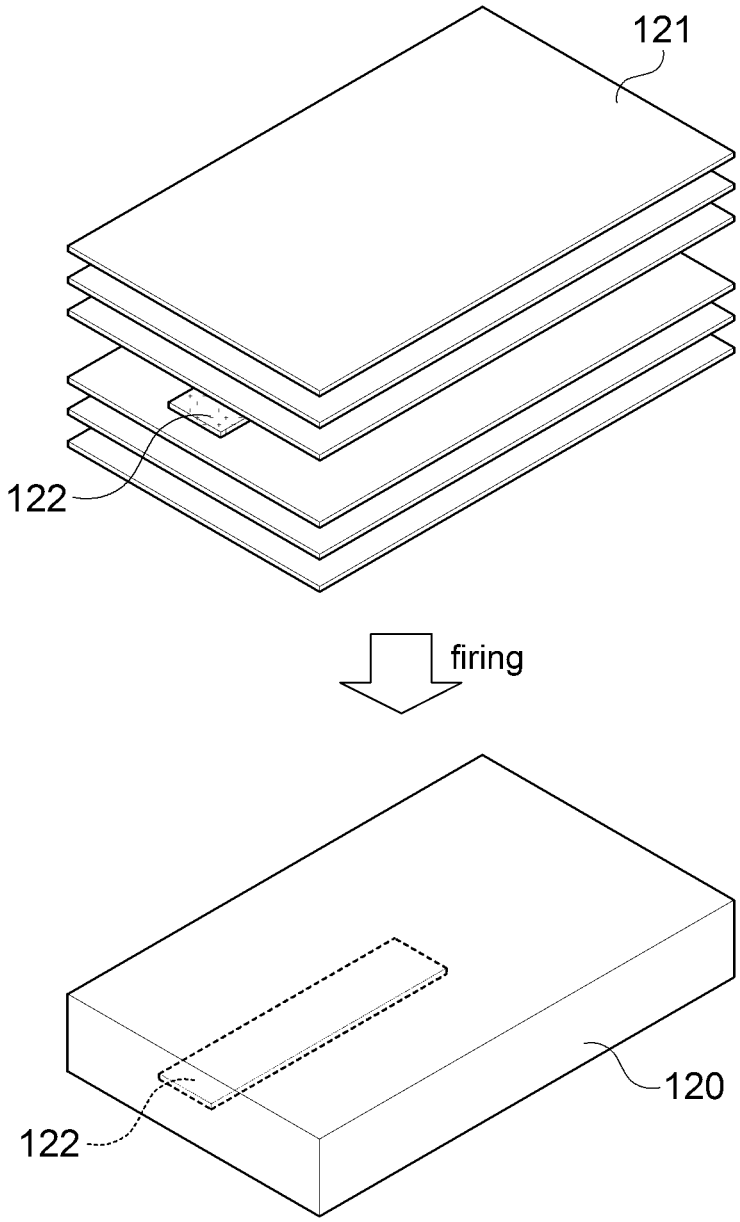

[FIG. 2B]
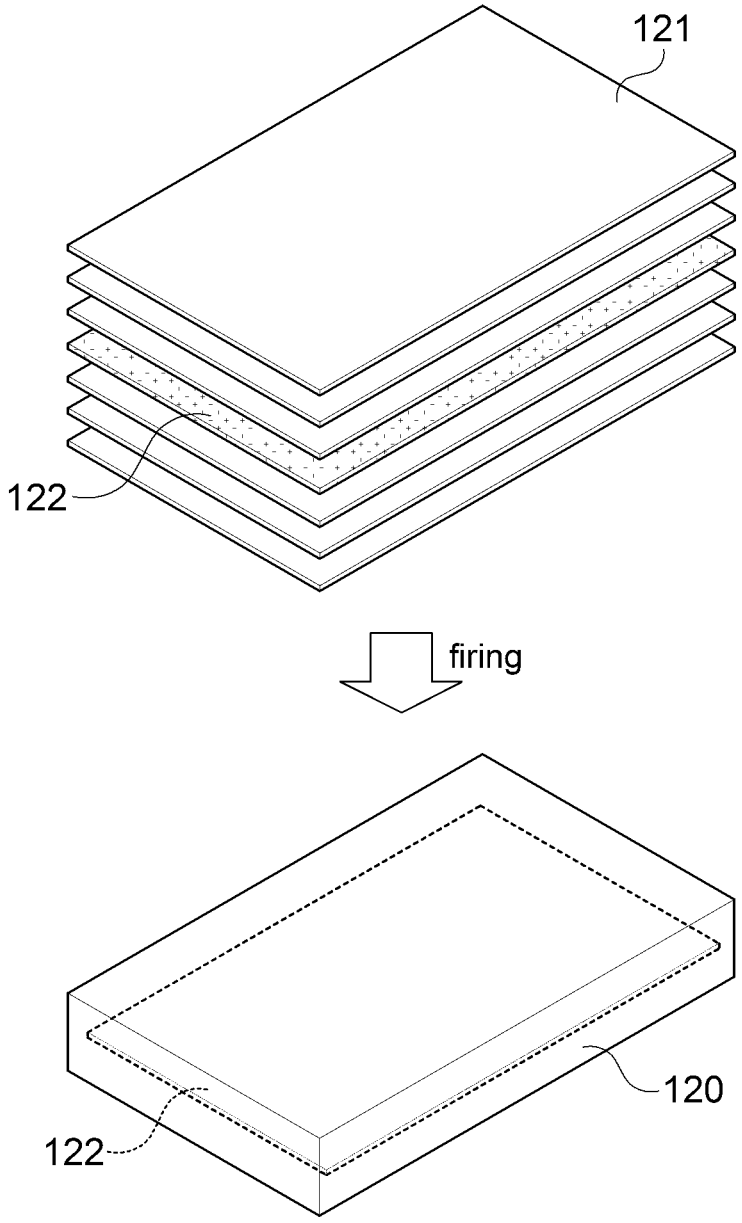

[FIG. 3A]
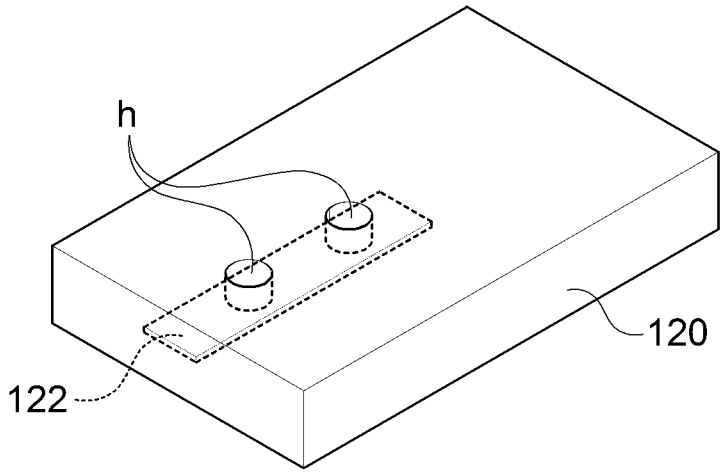
[FIG. 3B]
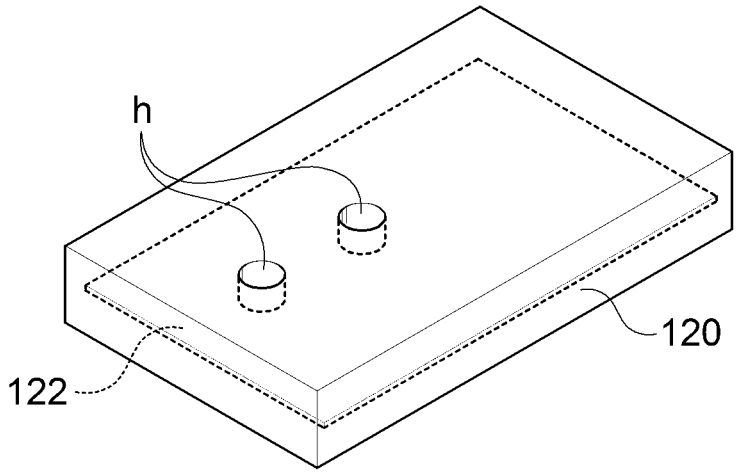

[FIG. 4A]
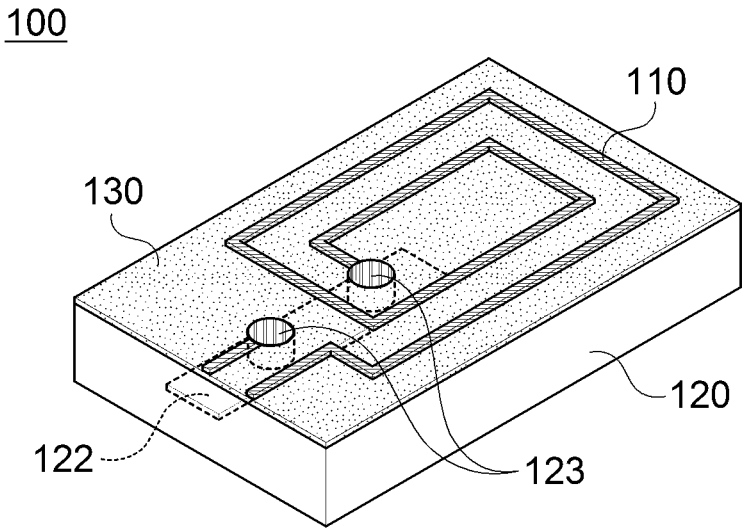
[FIG. 4B]
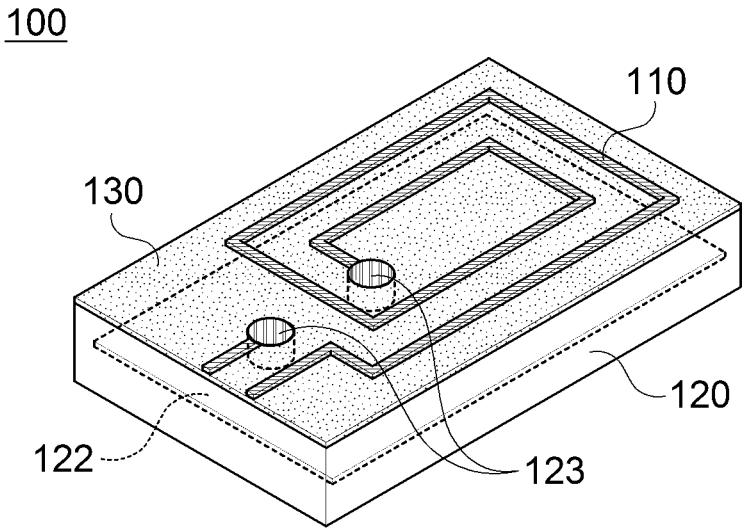

[FIG. 5]
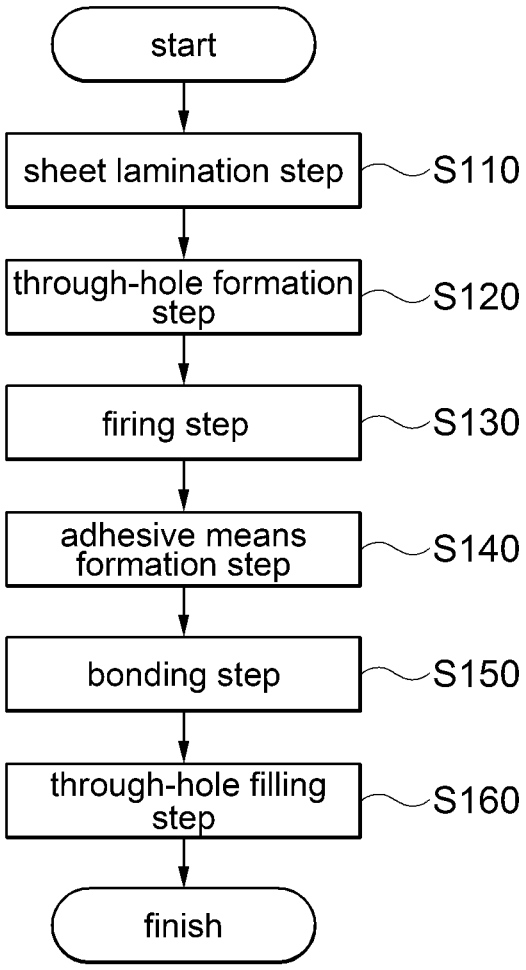

[FIG. 6A]
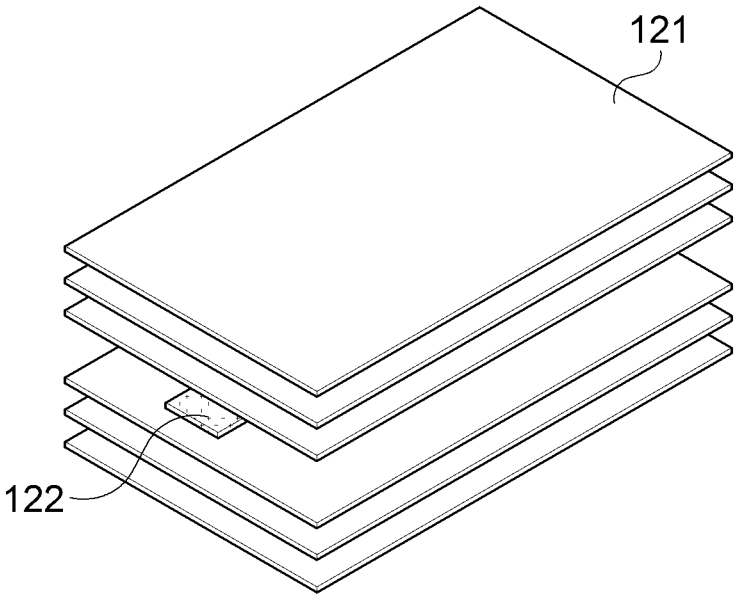
[FIG. 6B]
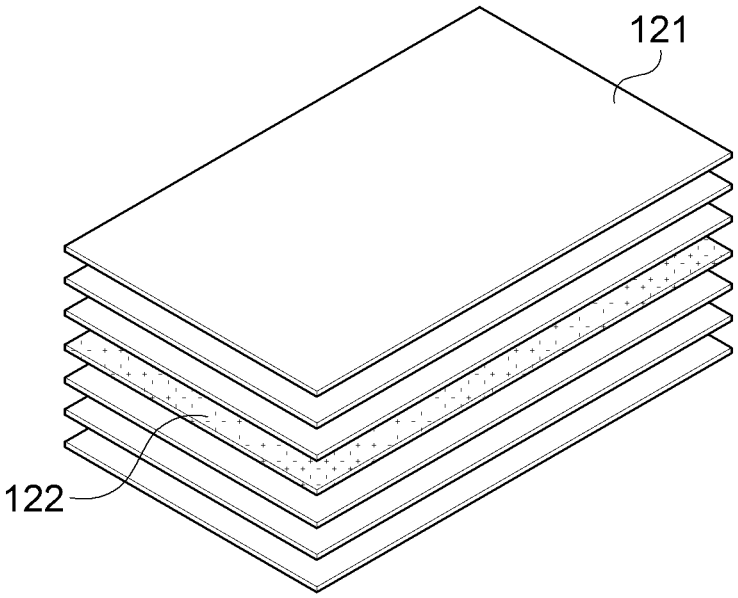

[FIG. 7A]
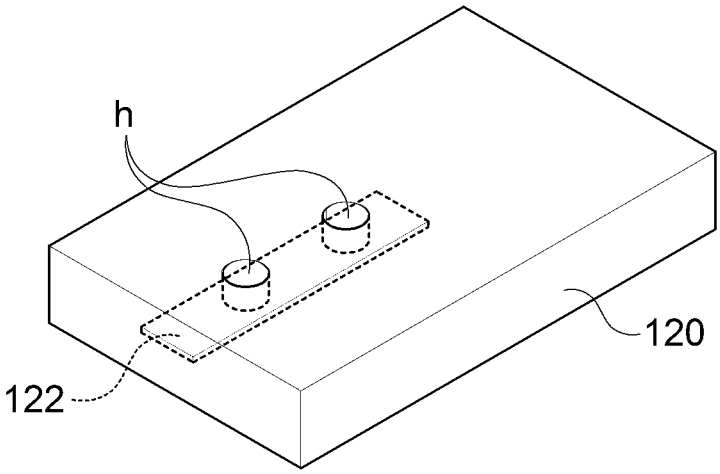
[FIG. 7B]
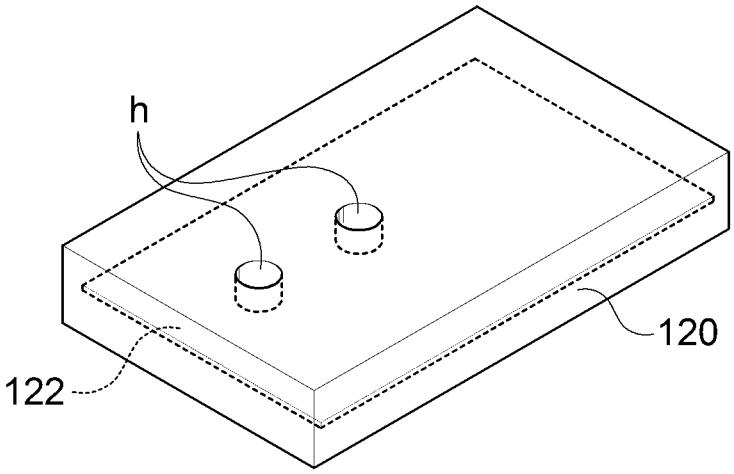

[FIG. 8A]
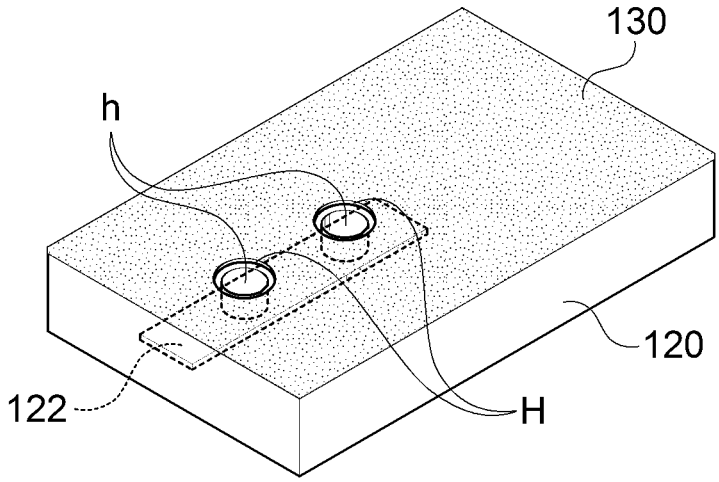
[FIG. 8B]
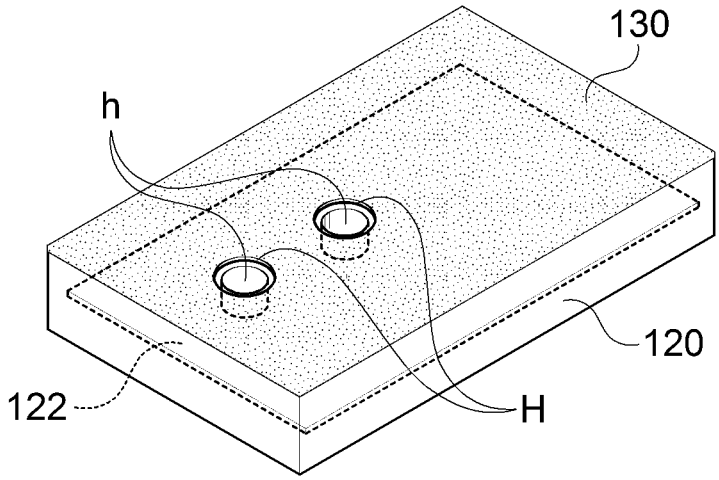

[FIG. 9A]
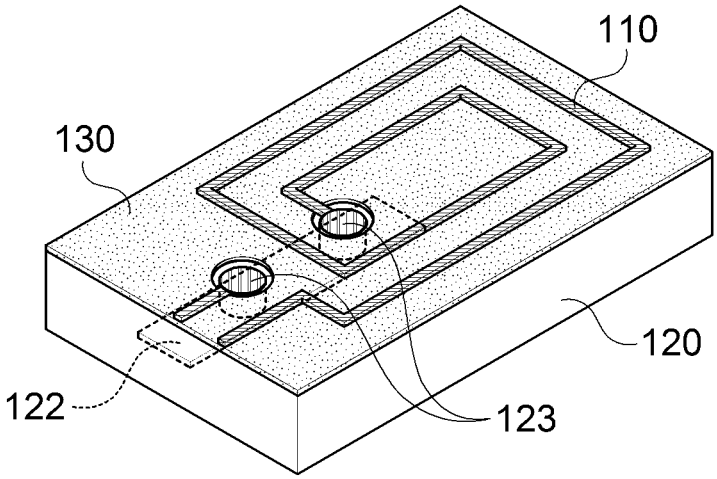
[FIG. 9B]
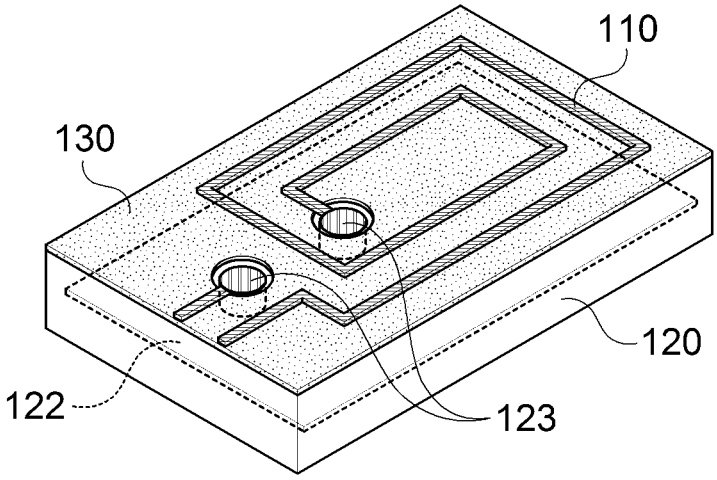

[FIG. 10]
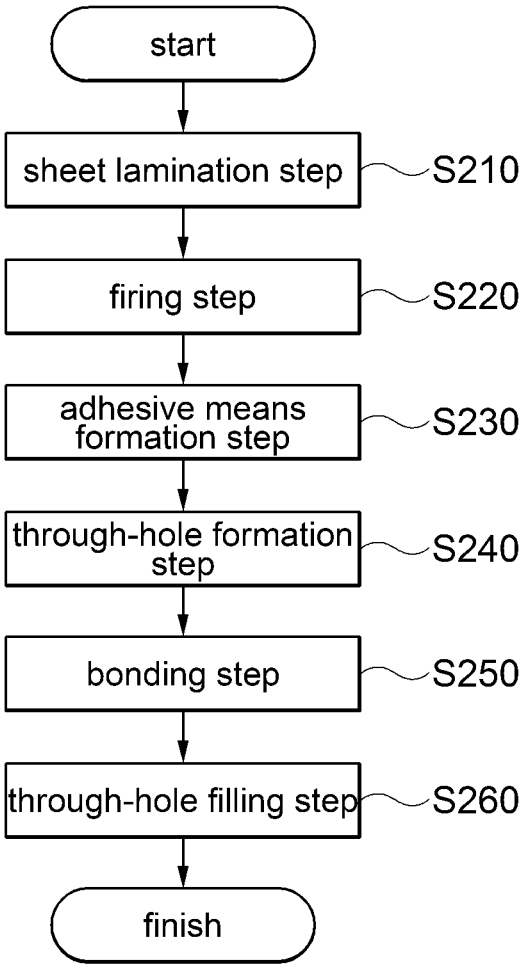

[FIG. 11A]
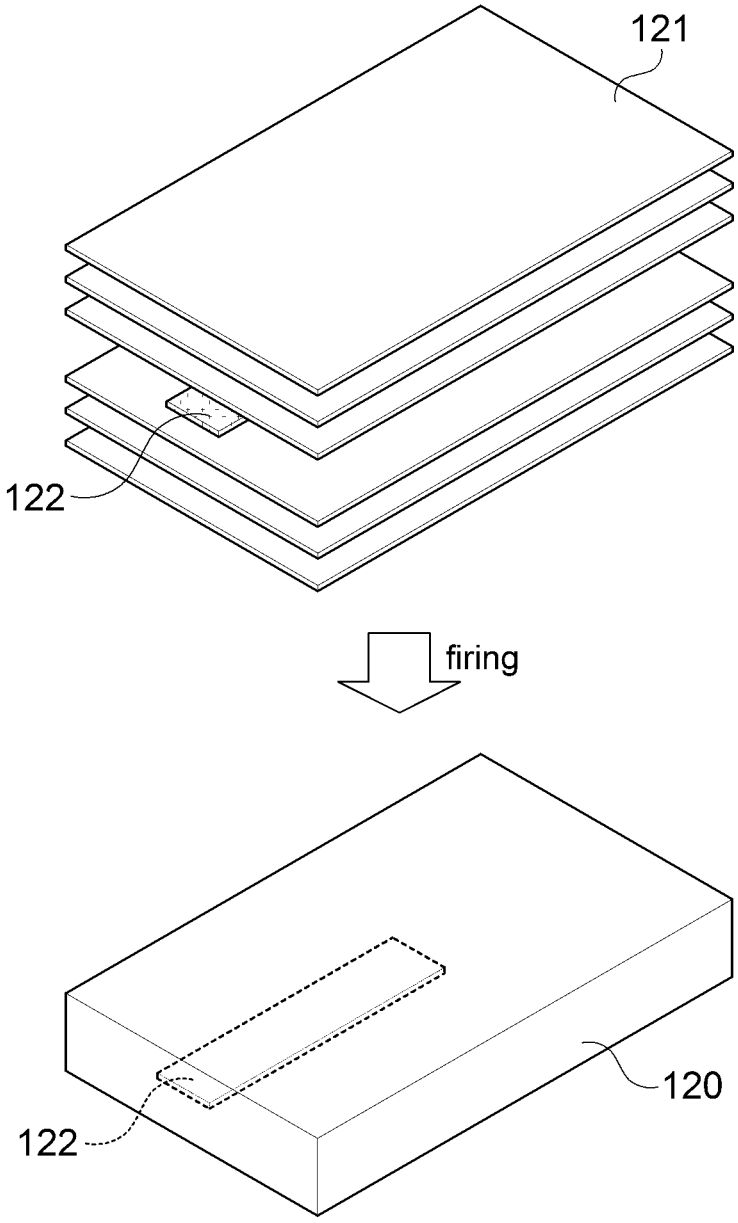

[FIG. 11B]
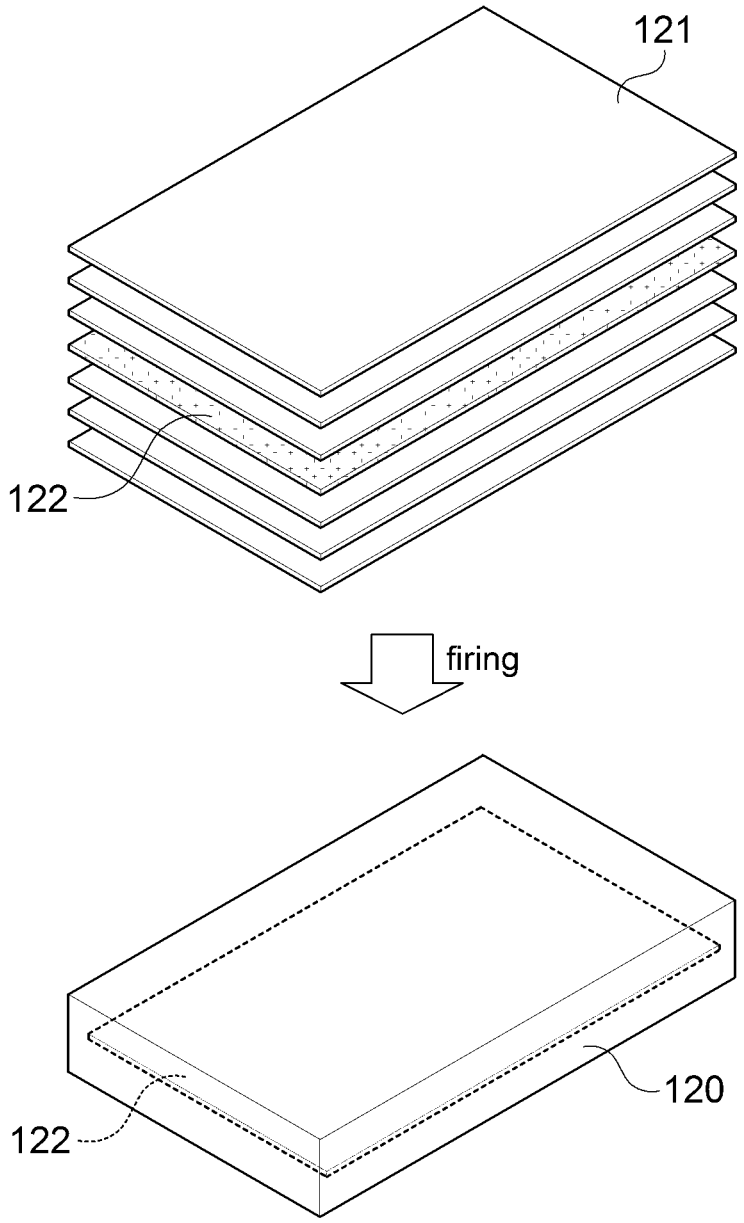

[FIG. 12A]
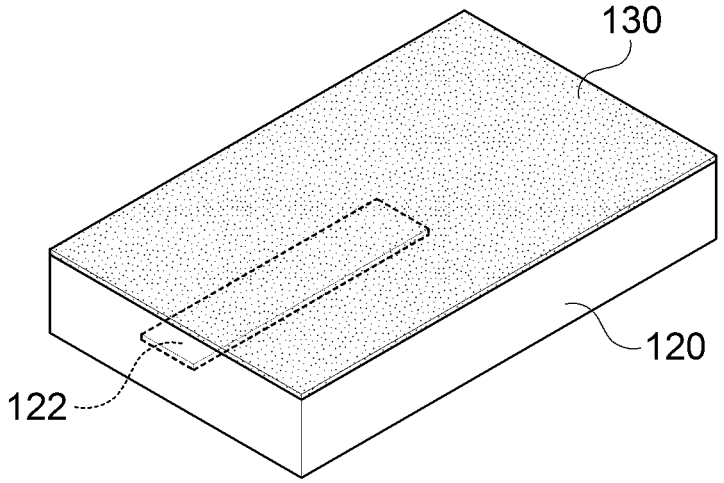
[FIG. 12B]
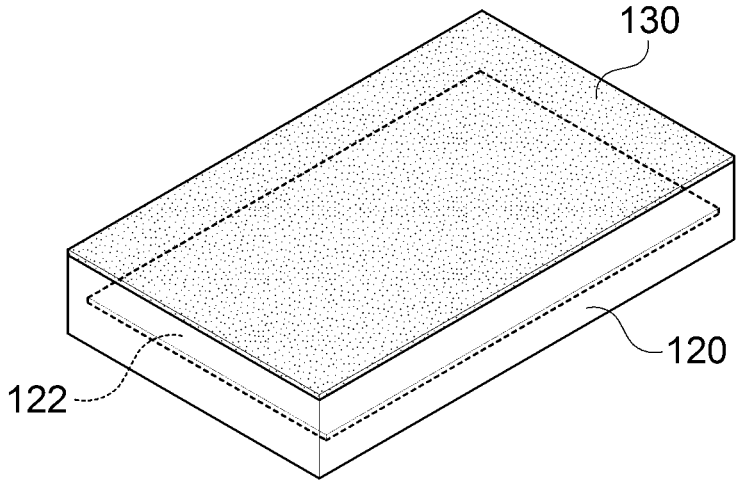

[FIG. 13A]
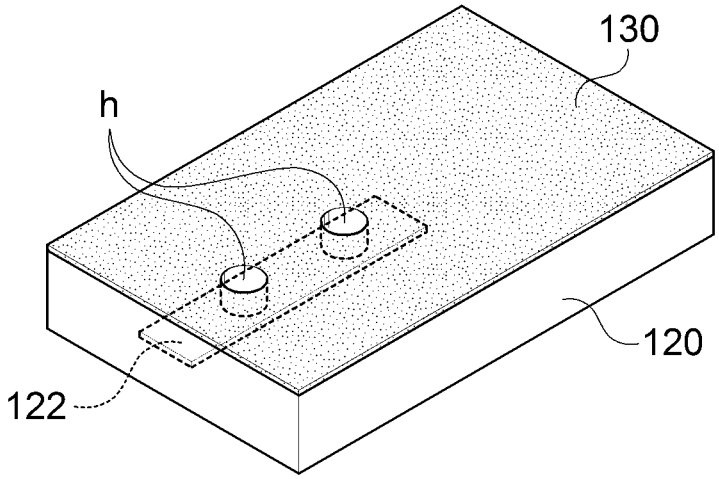
[FIG. 13B]
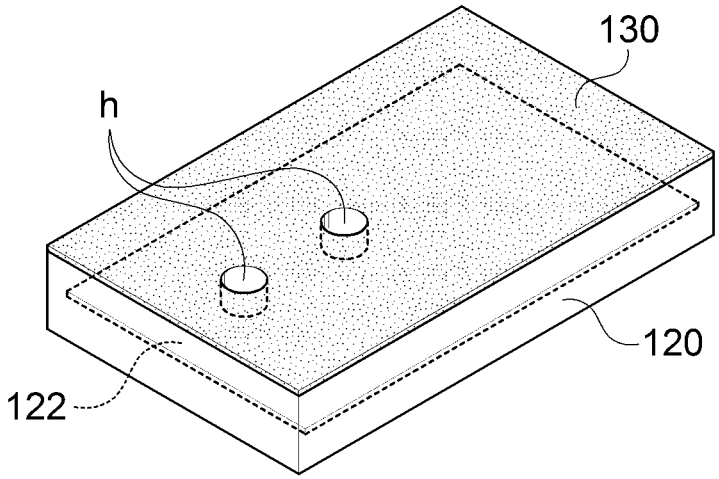

[FIG. 14A]
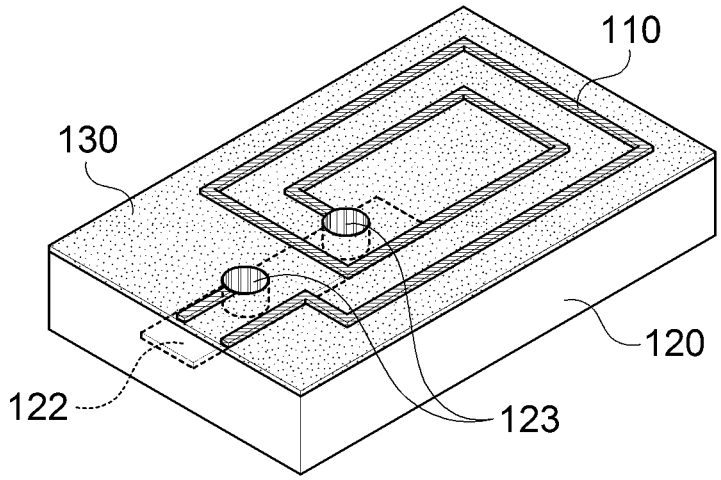
[FIG. 14B]
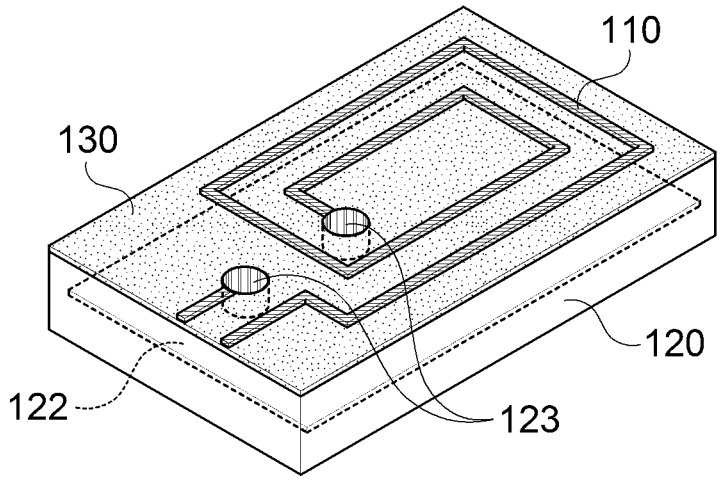

[FIG. 15]
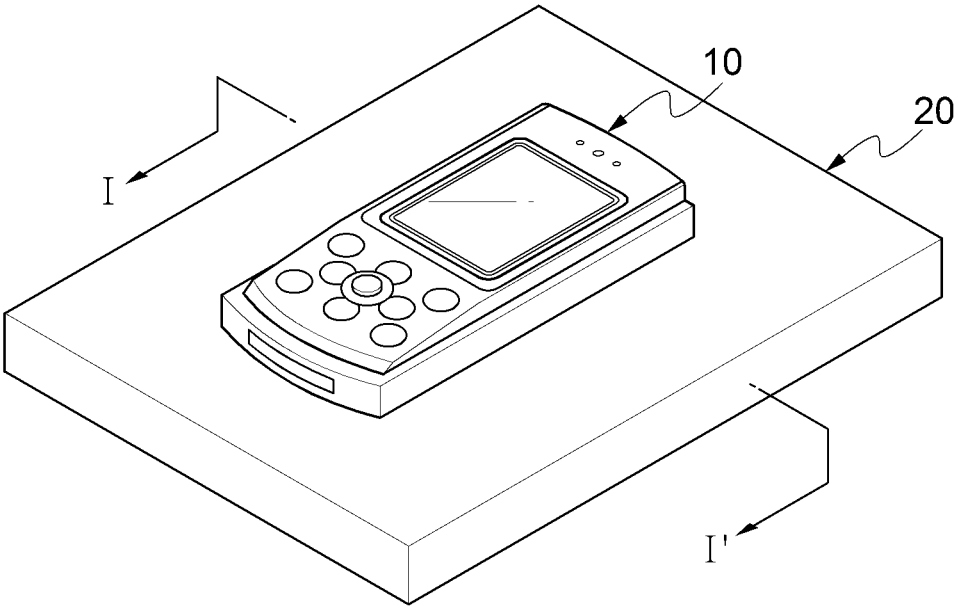
[FIG. 16]
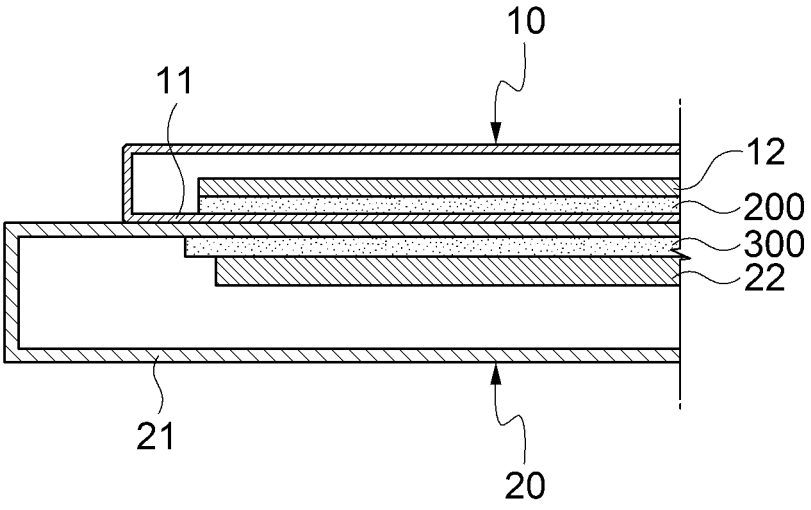

[FIG. 17]
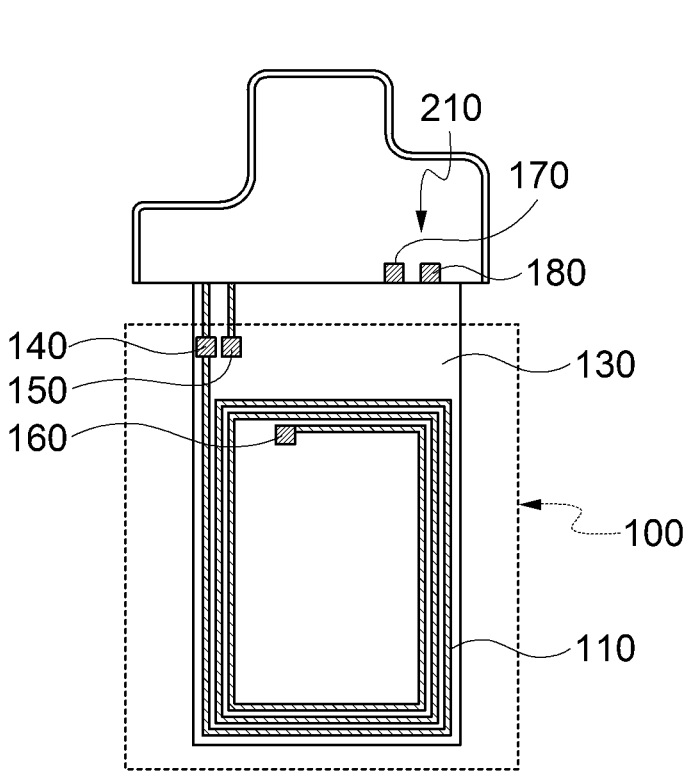

[FIG. 18A]
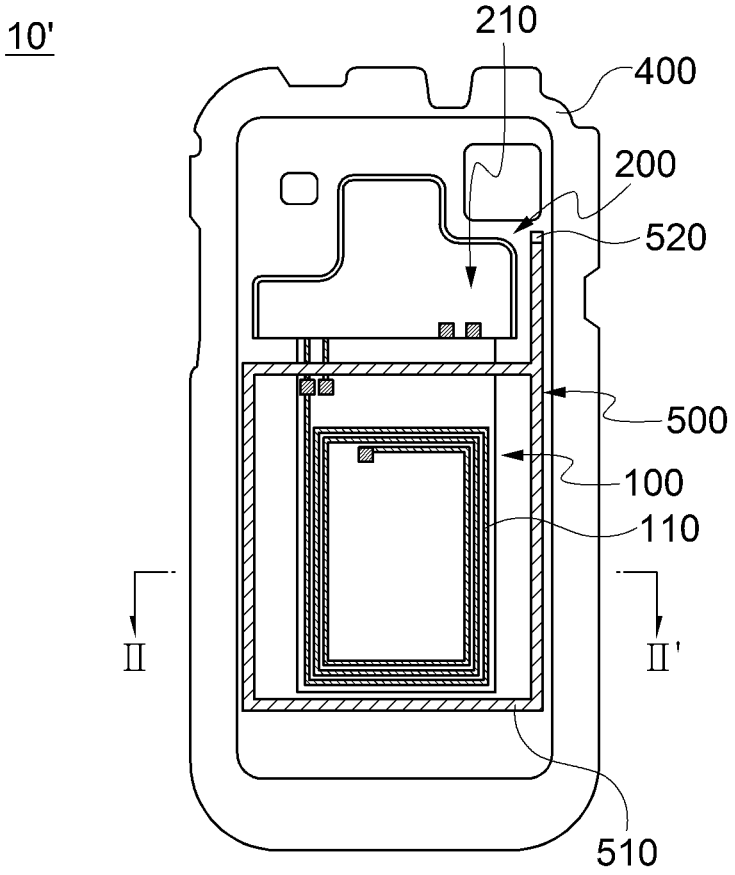
[FIG. 18B]
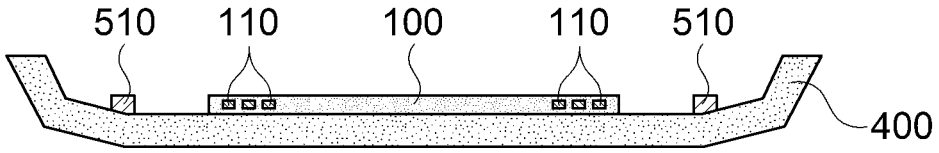

COIL TYPE UNIT FOR WIRELESS POWER TRANSMISSION, WIRELESS POWER TRANSMISSION DEVICE, ELECTRONIC DEVICE AND MANUFACTURING METHOD OF COIL TYPE UNIT FOR WIRELESS POWER TRANSMISSION

CROSS REFERENCE TO RELATED APPLICATION

This application claims the benefit under 35 U.S.C. Section 119 of Korean Patent Application Serial No. 10-2013-0086801, entitled filed Jul. 23, 2013, which is hereby incorporated by reference in its entirety into this application.

BACKGROUND OF THE INVENTION

1. Field of the Invention

The present invention relates to a coil type unit for wireless power transmission, a wireless power transmission device, an electronic device, and a manufacturing method of a coil type unit for wireless power transmission.

2. Description of the Related Art

In recent times, a wireless power transmission system has been studied to charge a secondary battery embedded in a mobile terminal etc.

In general, the wireless power transmission device includes a wireless power transmission device that transmits power and a wireless power reception device that receives and stores power.

The wireless power transmission device transmits and receives power using electromagnetic induction. For this, a coil is provided inside the wireless power transmission device.

The coil provided at this time is a coil that electrically connects a plurality of coil patterns through a via-hole, but the thickness of the coil is increased and there are problems in terms of cost due to the plurality of coil patterns. Thus, recently, a coil having a single-layered coil pattern has been used.

However, in case of the single-layered coil pattern, since the output wiring coil should pass over the wound coil wiring for electrical connection between an inner end and an outer end of the coil, the overall thickness of the coil becomes double.

Therefore, since the overall thickness of the coil is increased and wiring forming and bonding processes for electrical connection are added, process costs are increased and manufacturing becomes inconvenient.

Therefore, in order to meet the current trend for thinner devices, there is a need for the development of a thinner coil type unit for wireless power transmission and a wireless power transmission device and an electronic device including the same.

RELATED ART DOCUMENT

Patent Document

Patent Document 1: Korean Patent Laid-Open Publication No. 2012-0008200

SUMMARY OF THE INVENTION

The present invention has been invented in order to overcome the above-described problems and it is, therefore, an object of the present invention to provide a coil type unit for wireless power transmission and a manufacturing method thereof, a wireless power transmission device, and an electronic device that can achieve slimming by minimizing the thickness of a coil.

Further, it is another object of the present invention to provide a coil type unit for wireless power transmission and a manufacturing method thereof, a wireless power transmission device, and an electronic device that can reduce process costs and facilitate manufacture thereof.

In accordance with one aspect of the present invention to achieve the object, there is provided a coil type unit for wireless power transmission, including: a coil pattern in the form of a wiring pattern; a magnetic portion having the coil pattern attached to one surface thereof; and an adhesive portion interposed between the magnetic portion and the coil pattern to bond the magnetic portion and the coil pattern to each other, wherein the magnetic portion is formed by laminating one or more conductive sheets with one or more magnetic sheets and integrally firing the laminated sheets, and the magnetic portion has conductive holes formed in the position, where both ends of the coil pattern are disposed, to electrically connect the both ends of the coil pattern and the conductive sheet.

In an embodiment of the present invention, a wireless power transmission device may include a coil type unit for wireless power transmission in the present invention; and a circuit unit for wireless power transmission which is electrically connected to the coil type unit for wireless power transmission.

In an embodiment of the present invention, an electronic device may include a wireless power transmission device in the present invention; and a case for accommodating the wireless power transmission device therein.

And in accordance with another aspect of the present invention to achieve the object, there is provided a manufacturing method of a coil type unit for wireless power transmission, including: a sheet lamination step of laminating one or more conductive sheets with one or more magnetic sheets; a through-hole formation step of forming through-holes for connecting the conductive sheet to the laminated sheets laminated in the sheet lamination step; a firing step of integrally firing the laminated sheets having the through-holes formed therein; an adhesive means formation step of forming an adhesive means on the fired laminated sheet while not forming the adhesive means in the position of the through-holes; a bonding step of bonding a coil pattern in the form of a wiring pattern to the fired laminated sheet having the through-holes formed therein by the formed adhesive means while disposing both ends of the coil pattern in the position of the through-holes; and a through-hole filling step of electrically connecting the both ends of the coil pattern and the conductive sheet by filling a conductive material in the through-holes.

And in accordance with still another aspect of the present invention to achieve the object, there is provided a manufacturing method of a coil type unit for wireless power transmission, including: a sheet lamination step of laminating one or more conductive sheets with one or more magnetic sheets; a firing step of integrally firing the laminated sheets laminated in the sheet lamination step; an adhesive means formation step of forming an adhesive means on the fired laminated sheet; a through-hole formation step of forming through-holes for connecting the conductive sheet to the fired laminated sheet having the adhesive means formed thereon; a bonding step of bonding a coil pattern in the form of a wiring pattern to the fired laminated sheet having the through-holes formed therein by the formed adhesive means while disposing both ends of the coil pattern in the position of the through-holes; and a through-hole filling step of electrically connecting the both ends of the coil pattern and the conductive sheet by filling a conductive material in the through-holes.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIG. 1 is an exploded perspective view of a coil type unit for wireless power transmission in accordance with an embodiment of the present invention;

FIG. 2 is a perspective view showing a magnetic portion formed by laminating a magnetic sheet and a conductive sheet and integrally firing the laminated sheets;

FIG. 3 is a perspective view showing the magnetic portion having through holes formed therein;

FIG. 4 is a perspective view of the coil type unit for wireless power transmission in which a coil pattern is bonded to the magnetic portion having conductive holes formed therein;

FIG. 5 is a flowchart for explaining a manufacturing method of a coil type unit for wireless power transmission in accordance with a first embodiment of the present invention;

FIG. 6 is a process diagram showing a sheet lamination step of FIG. 5;

FIG. 7 is a process diagram showing a through-hole formation step and a firing step of FIG. 5;

FIG. 8 is a process diagram showing an adhesive means formation step of FIG. 5;

FIG. 9 is a process diagram showing a bonding step and a through-hole filling step of FIG. 5;

FIG. 10 is a flowchart for explaining a manufacturing method of a coil type unit for wireless power transmission in accordance with a second embodiment of the present invention;

FIG. 11 is a process diagram showing a sheet lamination step and a firing step of FIG. 10;

FIG. 12 is a process diagram showing an adhesive means formation step of FIG. 10;

FIG. 13 is a process diagram showing a through-hole formation step of FIG. 10;

FIG. 14 is a process diagram showing a bonding step and a through-hole filling step of FIG. 10;

FIG. 15 is a perspective view schematically showing an electronic device and a charging device in accordance with an embodiment of the present invention;

FIG. 16 is a cross-sectional view taken along line I-I' of FIG. 15;

FIG. 17 is a perspective view of a wireless power reception device in accordance with an embodiment of the present invention; and FIG. 18 is a view schematically showing an electronic device including a wireless power reception device and an antenna module in accordance with an embodiment of the present invention.

DETAILED DESCRIPTION OF THE PREFERABLE EMBODIMENTS

A matter regarding to an operational effect including a technical configuration for an object of a coil type unit for wireless power transmission and a manufacturing method thereof, a wireless power transmission device, and an electronic device in accordance with the present invention will be clearly appreciated through the following detailed description with reference to the accompanying drawings showing preferable embodiments of the present invention.

Further, in describing the present invention, descriptions of well-known techniques are omitted so as not to unnecessarily obscure the embodiments of the present invention. In the present specification, the terms "first," "second," and the like are used for distinguishing one element from another, and the elements are not limited by the above terms.

<Coil Type Unit for Wireless Power Transmission Device>

First, FIG. 1 is an exploded perspective view of a coil type unit 100 for wireless power transmission in accordance with an embodiment of the present invention.

As shown in FIG. 1, the coil type unit 100 for wireless power transmission in accordance with the present embodiment may include a coil pattern 110, a magnetic portion 120, and an adhesive portion 130.

First, the coil pattern 110 has a wiring pattern shape. As shown in FIG. 1, the present embodiment takes the case in which the coil pattern 110 having a single-layered wiring pattern shape is formed in the shape of an overall rectangular vortex, but the present invention is not limited thereto and allows perform various applications such as a circular or polygonal vortex as well as a multilayer wiring pattern.

Further, the adhesive portion 130 is interposed between the coil pattern 110 and the magnetic portion 120 to firmly fix and bond the coil pattern 110 and the magnetic portion 120 to each other.

The adhesive portion 130, as shown in FIG. 1, is disposed between the coil pattern 110 and the magnetic portion 120 to bond the coil pattern 110 and the magnetic portion 120 to each other.

The adhesive portion 130 may be formed of an adhesive film or an adhesive tape or may be formed by coating an adhesive or resin having adhesive properties on the surface of the magnetic portion 120. However, the adhesive portion 130 is not limited to the above configuration and allows various applications such as including ferrite powder to have magnetism with the magnetic portion 120.

Further, the magnetic portion 120 has the coil pattern 110 fixedly attached to one surface thereof and is provided to efficiently form a magnetic path of a magnetic field generated by the coil pattern 110. For this, the magnetic portion 120 is formed of a material that can easily form a magnetic path. For example, the magnetic portion 120 may be formed by laminating and firing magnetic casting sheets such as ferrite sheets.

However, the magnetic portion 120 according to the present embodiment does not limit the magnetic sheet only to the ferrite sheet and allows various applications such as use of at least one of a ferrite sheet, a metal sheet, and a hybrid type sheet that uses a combination of metal and ferrite as the magnetic sheet. At this time, the metal sheet may be made of Fe—Si—Al, Fe—Si—Cr, Fe—Si—Al—Cr that can improve magnetic efficiency (permeability and Q-factor) or aluminum considering conductivity of a metal sheet layer but is not limited thereto.

Meanwhile, FIG. 2 is a perspective view showing the magnetic portion 120 in accordance with the present embodiment formed by laminating a magnetic sheet 121 and a conductive sheet 122 together and integrally firing the laminated sheets. At this time, FIG. 2*a* shows the case in which the conductive sheet 122 is laminated on a part of the surface of one sheet layer, and FIG. 2*b* shows the case in which the conductive sheet 122 is laminated on the entire surface of one sheet layer.

As shown in FIG. 2, the magnetic portion 120 may be formed by laminating the magnetic sheet 121 and the conductive sheet 122 together and integrally firing the laminated sheets.

As shown in FIG. 2, the present embodiment takes the case in which one conductive sheet 122 is laminated with one or more magnetic sheets 121, but the present invention is not limited thereto and allows various applications such as laminating one or more conductive sheets with one or more magnetic sheets according to the need.

Further, the conductive sheet 122 according to the present embodiment may be laminated on a part of the surface of one sheet layer on which the conductive sheet 122 is to be laminated as shown in FIG. 2*a* or may be laminated on the entire surface of one sheet layer on which the conductive sheet 122 is to be laminated as shown in FIG. 2*b*.

Further, the conductive sheet 122 according to the present embodiment may be formed on a part of the surface of the sheet layer or on the entire surface of the sheet layer by printing and laminating conductive ink or conductive paste. At this time, the conductive paste may be paste including silver powder, particularly paste including silver powder as a main material but is not limited thereto.

Meanwhile, FIG. 3 is a perspective view showing the magnetic portion 120 in which through-holes h are formed, wherein FIG. 3*a* shows the case in which the conductive sheet 122 is laminated on a part of the surface of one sheet layer, and FIG. 3*b* shows the case in which the conductive sheet 122 is laminated on the entire surface of one sheet layer.

At this time, the through-holes h may be formed by a laser, CNC drilling, or punching process but are not limited thereto.

Further, FIG. 4 is a perspective view of the coil type unit 100 for wireless power transmission in which the coil pattern 110 is bonded to the magnetic portion 120 having conductive holes 123 formed therein, wherein FIG. 4*a* shows the case in which the conductive sheet 122 is laminated on a part of the surface of one sheet layer, and FIG. 4*b* shows the case in which the conductive sheet 122 is laminated on the entire surface of one sheet layer.

As shown in FIGS. 3 and 4, the magnetic portion 120 according to the present embodiment may have the conductive holes 123 formed in the position, where both ends of the coil pattern 110 are disposed, to electrically connect the both ends of the coil pattern 110 and the conductive sheet 122.

At this time, the conductive hole 123 may be formed by filling conductive ink or conductive paste in the through-hole h as in FIGS. 3*a* and 3*b*. For example, at this time, the conductive paste may be paste including silver powder, particularly paste including silver powder as a main material but is not limited thereto.

<Manufacturing Method of Coil Type Unit for Wireless Power Transmission>

First Embodiment

First, FIG. 5 is a flowchart for explaining a manufacturing method of a coil type unit for wireless power transmission in accordance with a first embodiment of the present invention.

Referring to FIG. 5, the manufacturing method of a coil type unit for wireless power transmission may include a sheet lamination step S110 of laminating one or more conductive sheets with one or more magnetic sheets, a through-hole formation step S120 of forming through-holes for connecting the conductive sheet to the laminated sheets laminated in the sheet lamination step S110; a firing step S130 of integrally firing the laminated sheets having the through-holes formed therein; an adhesive means formation step S140 of forming an adhesive means on the fired laminated sheet while not forming the adhesive means in the position of the through-holes; a bonding step S150 of bonding a coil pattern having a wiring pattern shape to the fired laminated sheet having the through-holes formed therein by the formed adhesive means while disposing both ends of the coil pattern in the position of the through-holes; and a through-hole filling step S160 of electrically connecting the both ends of the coil pattern and the conductive sheet by filling a conductive material in the through-holes.

FIGS. 6 to 9 are process diagrams showing the manufacturing method of a coil type unit for wireless power transmission in accordance with the first embodiment of the present invention and each step of the above manufacturing method will be specifically described below with reference to the process diagrams.

First, FIG. 6 is a process diagram showing the sheet lamination step S110 of FIG. 5, wherein FIG. 6*a* shows the sheet lamination step of laminating a conductive sheet 122 on a part of the surface of one sheet layer, and FIG. 6*b* shows the sheet lamination step of laminating the conductive sheet 122 on the entire surface of one sheet layer.

As shown in FIG. 6, in the sheet lamination step S110 according to the present embodiment, one or more magnetic sheets 121 and conductive sheets 122 are laminated together. However, FIG. 6 takes the case in which one conductive sheet 122 is laminated with one or more magnetic sheets 121, but the present invention is not limited to the above case and allows various applications according to the need, such as laminating one or more conductive sheets with one or more magnetic sheets.

Further, at this time, the magnetic sheet 121, for example, may be a ferrite sheet, but without being limited thereto, allows various applications such as using at least one of a ferrite sheet, a metal sheet, and a hybrid type sheet that uses a combination of metal and ferrite. At this time, the metal sheet may be made of Fe—Si—Al, Fe—Si—Cr, Fe—Si—Al—Cr that can improve magnetic efficiencies (permeability and Q-factor) or aluminum considering conductivity of a metal sheet layer but is not limited thereto.

Further, in the sheet lamination step S110 according to the present embodiment, as shown in FIG. 6*a*, the conductive sheet 122 may be laminated on a part of the surface of one sheet layer on which the conductive sheet 122 is to be laminated, and as shown in FIG. 6*b*, the conductive sheet 122 may be laminated on the entire surface of one sheet layer on which the conductive sheet 122 is to be laminated.

At this time, the conductive sheet 122 may be formed on a part of the surface of the sheet layer or on the entire surface of the sheet layer by printing and laminating conductive ink or conductive paste. At this time, the conductive paste may be paste including silver powder, particularly paste including silver powder as a main material but is not limited thereto.

Next, FIG. 7 is a process diagram showing the through-hole formation step S120 and the firing step S130 of FIG. 5, wherein FIG. 7*a* shows the through-hole formation step and the firing step of the laminated sheet in which the conductive sheet 122 is laminated on a part of the surface of one sheet layer, and FIG. 7*b* shows the through-hole formation step and the firing step of the laminated sheet in which the conductive sheet 122 is laminated on the entire surface of one sheet layer.

As shown in FIG. 7, through-holes h for connecting the conductive sheet 122 to the laminated sheet laminated in FIG. 6 are formed, and a magnetic portion 120 is formed by integrally firing the laminated sheets having the through-holes h. At this time, the through-holes h may be formed by a laser, CNC drilling, or punching process but are not limited thereto.

Next, FIG. 8 is a process diagram showing the adhesive means formation step S140 of FIG. 5, wherein FIG. 8*a* shows the adhesive means formation step in the fired laminated sheet (magnetic portion 120) in which the conductive sheet 122 is laminated on a part of the surface of one sheet layer, and FIG. 8*b* shows the adhesive means formation step in the fired laminated sheet 120 in which the conductive sheet 122 is laminated on the entire surface of one sheet layer.

As shown in FIG. 8, in the adhesive means formation step S140 according to the present embodiment, an adhesive means 130 is formed on the laminated sheet fired in FIG. 7, but the adhesive means 130 may not be formed in the position of the through-holes h of the fired laminated sheet 120.

At this time, the reason why the adhesive means 130 is not formed in the position of the through-holes h is to perform the through-hole filling step S160 of FIG. 5 for forming conductive holes later. Accordingly, it is preferred that the diameter of a portion H without the adhesive means 130 is equal to the diameter of the through-hole h or larger than the diameter of the through-hole h.

Further, the adhesive means 130 in the adhesive means formation step S140 of FIG. 8 may be formed of an adhesive film or adhesive tape or may be formed by coating an adhesive or resin having adhesive properties on the surface of the laminated sheet fired 120 in FIG. 7. But the adhesive portion 130 is not limited to the above configuration and allows various applications such as including ferrite power to have magnetism with the fired laminated sheet 120.

Next, FIG. 9 is a process diagram showing the bonding step S150 and the through-hole filling step S160 of FIG. 5, wherein FIG. 9*a* shows the bonding step and the through-hole filling step in the fired laminated sheet 120 in which the conductive sheet 122 is laminated on a part of the surface of one sheet layer, and FIG. 9*b* shows the bonding step and the through-hole filling step in the fired laminated sheet 120 in which the conductive sheet 122 is laminated on the entire surface of one sheet layer.

As shown in FIG. 9, in the bonding step S150 according to the present embodiment, the coil pattern 110 having a wiring pattern shape is bonded to the fired laminated sheet 120 having through-holes formed in FIG. 7 by the adhesive means 130 formed in FIG. 8. At this time, the coil pattern 110 may be bonded so that the both ends of the coil pattern 110 are disposed in the position of the through-holes of the fired laminated sheet 120.

At this time, the coil pattern 110 has a wiring pattern shape. As shown in FIG. 9, the present embodiment takes the case in which the coil pattern 110 having a single-layered wiring pattern shape is formed in the shape of an overall rectangular vortex, but the present invention is not limited thereto and allows various applications such as a circular or polygonal vortex as well as a multilayer wiring pattern.

Further, as shown in FIG. 9, in the through-hole filling step S160 according to the present embodiment, the conductive holes 123 are formed to electrically connect the both ends of the coil pattern 110 and the conductive sheet 122 by filling a conductive material in the through-holes formed in FIG. 7.

Further, in the through-hole filling step S160 according to the present embodiment, the conductive material filled in the through-holes may be conductive ink or conductive paste.

At this time, the conductive paste may be paste including silver powder, particularly paste including silver powder as a main material but is not limited thereto.

Second Embodiment

First, FIG. 10 is a flowchart for explaining a manufacturing method of a coil type unit for wireless power transmission in accordance with a second embodiment of the present invention.

Referring to FIG. 10, the manufacturing method of a coil type unit for wireless power transmission according to the second embodiment of the present invention may include a sheet lamination step S210 of laminating one or more conductive sheets with one or more conductive sheets; a firing step S220 of integrally firing the laminated sheets laminated in the sheet lamination step S210; an adhesive means formation step S230 of forming an adhesive means on the fired laminated sheet; a through-hole formation step S240 of forming through-holes for connecting the conductive sheet to the fired laminated sheet having the adhesive means formed thereon; a bonding step S250 of bonding a coil pattern having a wiring pattern shape to the fired laminated sheet having the through-holes formed therein by the formed adhesive means while disposing both ends of the coil pattern in the position of the through-holes; and a through-hole filling step S260 of electrically connecting the both ends of the coil pattern and the conductive sheet by filling a conductive material in the through-holes.

FIGS. 11 to 14 are process diagrams showing the manufacturing method of a coil type unit for wireless power transmission in accordance with the second embodiment of the present invention and each step of the above manufacturing method will be specifically described below with reference to the process diagrams.

First, FIG. 11 is a process diagram showing the sheet lamination step S210 and the firing step S220 of FIG. 10, wherein FIG. 11*a* shows the sheet lamination step of laminating the conductive sheet 122 on a part of the surface of one sheet layer and the firing step of the laminated sheet, and FIG. 11*b* shows the sheet lamination step of laminating the conductive sheet 122 on the entire surface of one sheet layer and the firing step of the laminated sheet.

As shown in FIG. 11, in the sheet lamination step S210 according to the present embodiment, as in the first embodiment, one or more magnetic sheets 121 and conductive sheets 122 are laminated together. However, FIG. 11 takes the case in which one conductive sheet 122 is laminated with one or more magnetic sheets 121, but the present invention is not limited to the above case and allows various applications according to the need such as laminating one or more conductive sheets with one or more magnetic sheets.

Further, at this time, the magnetic sheet 121, for example, may be a ferrite sheet but without being limited thereto, allows various applications such as using at least one of a ferrite sheet, a metal sheet, and a hybrid type sheet that uses a combination of metal and ferrite. At this time, the metal sheet may be made of Fe—Si—Al, Fe—Si—Cr, Fe—Si—Al—Cr that can improve magnetic efficiencies (permeability and Q-factor) or aluminum considering conductivity of a metal sheet layer but is not limited thereto.

Further, in the sheet lamination step S210 according to the present embodiment, as shown in FIG. 11*a*, the conductive sheet 122 may be laminated on a part of the surface of one sheet layer on which the conductive sheet 122 is to be laminated, and as shown in FIG. 11*b*, the conductive sheet 122 may be laminated on the entire surface of one sheet layer on which the conductive sheet 122 is to be laminated.

At this time, the conductive sheet 122 may be formed on a part of the surface of the sheet layer or on the entire surface of the sheet layer by printing and laminating conductive ink or conductive paste. At this time, the conductive paste may be paste including silver powder, particularly paste including silver powder as a main material but is not limited thereto.

Further, in the firing step S220 according to the present embodiment, as shown in FIG. 11, a magnetic portion 120 is formed by integrally firing the laminated sheets laminated in the sheet lamination step S210, that is, the magnetic sheets 121 and the conductive sheets 122 laminated in the sheet lamination step S210.

Next, FIG. 12 is a process diagram showing the adhesive means formation step S230 of FIG. 10, wherein FIG. 12*a* shows the adhesive means formation step in the fired laminated sheet (magnetic portion 120) in which the conductive sheet 122 is laminated on a part of the surface of one sheet layer, and FIG. 12*b* shows the adhesive means formation step in the fired laminated sheet 120 in which the conductive sheet 122 is laminated on the entire surface of one sheet layer.

As shown in FIG. 12, in the adhesive means formation step S230 according to the present embodiment, the adhesive means 130 is formed on the laminated sheet fired in FIG. 11. At this time, the adhesive means 130 may be formed of an adhesive film or an adhesive tape or may be formed by coating an adhesive or resin having adhesive properties on the surface of the fired laminated sheet 120. But the adhesive portion 130 is not limited to the above configuration and allows various applications such as including ferrite powder to have magnetism with the fired laminated sheet 120.

Next, FIG. 13 is a process diagram showing the through-hole formation step S240 of FIG. 10, wherein FIG. 13*a* shows the through-hole formation step in a state in which the adhesive means 130 is formed on the fired laminated sheet 120 in which the conductive sheet 122 is laminated on a part of the surface of one sheet layer, and FIG. 13*b* shows the through-hole formation step in a state in which the adhesive means 130 is formed on the fired laminated sheet 120 in which the conductive sheet 122 is laminated on the entire surface of one sheet layer.

As shown in FIG. 13, in the through-hole formation step S240 according to the present embodiment, the through-holes h for connecting the conductive sheet 122 to the fired laminated sheet 120 having the adhesive means 130 formed in FIG. 12 are formed. At this time, the through-holes h may be formed by a laser, CNC drilling, or punching process but aren't limited thereto.

Next, FIG. 14 is a process diagram showing the bonding step S250 and the through-hole filling step S260 of FIG. 10, wherein FIG. 14*a* shows the bonding step and the through-hole filling step in the fired laminated sheet 120 in which the conductive sheet 122 is laminated on a part of the surface of one sheet layer, and FIG. 14*b* shows the bonding step and the through-hole filling step in the fired laminated sheet 120 in which the conductive sheet 122 is laminated on the entire surface of one sheet layer.

As shown in FIG. 14, in the bonding step S250 according to the present embodiment, the coil pattern 110 having a wiring pattern shape is bonded to the fired laminated sheet 120 having the through-holes formed in FIG. 13 by the adhesive means 130 formed in FIG. 12. At this time, the coil pattern 110 may be bonded so that the both ends of the coil pattern 110 are disposed in the position of the through-holes of the fired laminated sheet 120.

At this time, the coil pattern 110 has a wiring pattern shape. As shown in FIG. 14, the present embodiment takes the case in which the coil pattern 110 having a single-layered wiring pattern shape is formed in the shape of an overall rectangular vortex, but the present invention is not limited thereto and allows various applications such as a circular or polygonal vortex as well as a multilayer wiring pattern.

Further, as shown in FIG. 14, in the through-hole filling step S260 according to the present embodiment, conductive holes 123 are formed to electrically connect the both ends of the coil pattern 110 and the conductive sheet 122 by filling a conductive material in the through-holes formed in FIG. 13.

Further, in the through-hole filling step S260 according to the present embodiment, the conductive material filled in the through-holes may be conductive ink or conductive paste.

At this time, the conductive paste may be paste including silver powder, particularly paste including silver powder as a main material but is not limited thereto.

<Wireless Power Transmission Device and Electronic Device>

FIG. 15 is a perspective view schematically showing an electronic device 10 and a charging device 20 in accordance with an embodiment of the present invention, and FIG. 16 is a cross-sectional view taken along line I-I' of FIG. 15.

Referring to FIGS. 15 and 16, the electronic device 10 according to the present embodiment may include a battery 12, a wireless power reception device 200, and cases 11 and 21.

First, the battery 12, which stores power generated from the wireless power reception device 200, may be a rechargeable secondary battery and configured to be detachable from the electronic device 10.

Further, the wireless power reception device 200, which supplies power to the battery 12 to charge the battery 12, may be received in the case 11 of the electronic device 10 to be directly attached to the inner surface of the case 11 or disposed as close as possible to the inner surface of the case 11.

Further, the charging device 20 according to the present embodiment is provided to charge the battery 12 of the electronic device 10. For this, the charging device 20 may have a wireless power transmission device 300 inside the case 21 thereof.

The cases 11 and 21, which accommodate the wireless power transmission device therein, may be an external case frame of the electronic device 10 or a case frame of the battery 12.

Further, the charging device 20 converts household AC power supplied from the outside into DC power and converts the DC power into an AC voltage of specific frequency again to provide the AC voltage to the wireless power transmission device 300. For this, the charging device 20 may have a voltage converter 22 for converting household AC power into an AC voltage of specific frequency.

When the above AC voltage is applied to a coil of the wireless power transmission device 300, a magnetic field around the coil is changed. Therefore, a voltage is applied to the wireless power reception device 200 of the electronic device 10 adjacent to the wireless power transmission device 300 according to the changes in the magnetic field and thus the battery 12 is charged.

Hereinafter, the wireless power reception device 200 provided in the electronic device 10 will be described.

FIG. 17 is a perspective view of the wireless power reception device 200 in accordance with an embodiment of the present invention. As shown in FIG. 17, the wireless power reception device 200 according to the present embodiment may include a coil type unit 100 for wireless power transmission in accordance with the above-described embodiment of the present invention and a circuit unit 210 for wireless power transmission.

At this time, the coil type unit 100 and the circuit unit 210 according to the present embodiment are electrically connected to each other. For example, as shown in FIG. 17, the coil type unit 100 and the circuit unit 210 may be electrically connected by a first contact pad 140 and a second contact pad 150.

Although not limited thereto, when both ends of a coil consist of an inner end and an outer end like the coil type unit 100 of the present embodiment, the coil type unit 100 and the circuit unit 210 of the present embodiment may be electrically connected by connecting a third contact pad 160 formed on the inner end to the second contact pad 150 of the outer end through a conductive sheet and conductive holes formed inside a magnetic portion.

Meanwhile, first and second external connection pads 170 and 180 may be formed in the circuit unit 210 for wireless power transmission of the present embodiment.

Therefore, power received through the coil type unit 100 of the present embodiment can be connected to a battery (not shown) through the first and second external connection pads 170 and 180 after being processed through the circuit unit 210 of the present embodiment.

The first and second external connection pads 170 and 180 and the first to third connection pads 140, 150, and 160 of the present embodiment may be connected in various ways. For example, the first and second external connection pads 170 and 180 may be electrically connected by a separate wire. Further, the first to third contact pads 140, 150, and 160 may electrically connect the coil type unit 100 and the circuit unit 210 by forming a wiring pattern on an adhesive portion 130 of the coil type unit 100.

Further, the wireless power reception device 200 of the present embodiment configured as above can be attached to a structure inside a mobile phone case by a simple method such as an adhesive or a double-sided tape, thus reducing manufacturing costs and process costs.

Meanwhile, configuration of the wireless power reception device 200 described above can be equally applied to the wireless power transmission device 300 provided in the charging device 20. Therefore, detailed descriptions of the wireless power transmission device 300 will be omitted.

FIG. 18 shows an electronic device 10' including both of a wireless power reception device 200 and an antenna module 500 in accordance with an embodiment of the present invention.

The electronic device 10' according to the present embodiment includes a wireless power reception device 200 according to the present embodiment and a case 400 for accommodating the wireless power reception device 200 therein.

As described above, since the wireless power reception device 200 according to the present embodiment is implemented with a coil type unit 100 in which both ends of a coil pattern are electrically connected inside a magnetic portion through a conductive sheet and a conductive hole formed inside the magnetic portion, it can be slimmed. Further, the wireless power reception device 200 according to the present embodiment can be simply attached inside the case 400 by means such as a double-sided tape and an adhesive.

Further, the electronic device 10' according to the present embodiment may have interference between the wireless power reception device 200 and an antenna according to the frequency used when the wireless power reception device 200 and the various antennas are accommodated together.

Particularly, in case of wireless power transmission, power transmission may be performed in the low frequency band of 1 kHz to 10 MHz. In this case, the interference between the wireless power reception device 200 and the antenna may occur according to the position thereof when the frequency used is low like a low frequency band antenna.

Further, there are many constraints on space layout inside the electronic device 10' according to the miniaturization of the electronic device 10'. In addition, there are also constraints on layout of the wireless power transmission device and the low frequency antenna in order to prevent the interference between the wireless power transmission device and the low frequency antenna.

Referring to FIGS. 18*a* and 18*b*, the electronic device 10' according to the present embodiment may include the wireless power reception device 200 and the antenna module 500.

First, the wireless power reception device 200, as described above, may include the coil type unit 100 for wireless power transmission and a circuit unit 210 according to the present embodiment.

Further, the antenna module 500 may include an antenna pattern 510 formed to surround a coil pattern 110 in the wireless power reception device 200.

At this time, the antenna module 500 of the present embodiment may include an antenna pattern 510 and one or more connection terminals 520 connected to the antenna pattern 510 and a circuit board corresponding to the antenna pattern 510.

As shown in FIG. 18*b* showing a cross-section taken along line II-II' of FIG. 18*a*, the antenna pattern 510 of the antenna module 500 may be formed to surround the coil pattern 110 of the coil type unit 100 of the wireless power reception device 200, thus preventing the interference between the antenna pattern 510 and the coil pattern 110.

Further, the antenna module 500 of the present embodiment may be at least one selected from the group consisting of a near field communication (NFC) antenna, a radio frequency identification (RFID) antenna, a frequency modulation (FM) antenna, a digital multimedia broadcasting (DMB) antenna, and a wireless charging NFC antenna but can use various types of antennas without being necessarily limited to the above antennas.

Since the coil pattern in the wireless power transmission device of the present embodiment uses a frequency of 1 kHz to 10 MHz, the layout of the coil pattern and the antenna pattern according to the present embodiment can improve frequency reception efficiency and accuracy when applied to an NFC antenna and an RFID antenna using a frequency of 10 kHz to 100 MHz.

It is possible to implement a low frequency antenna such as an NFC or RFID antenna using 13.56 MHz with the wireless power transmission device (wireless power reception device) even when using 125 kHz band as a wireless power transmission frequency by forming the antenna pattern to surround the coil pattern as above.

The antenna module 500 of the present embodiment may be disposed above or below the wireless power reception device 200 or may be mounted to be attached to the case 400 with the wireless power reception device 200.

The electronic device 10' described above can be equally applied to the configuration in which the antenna module 500 is applied to a wireless power transmission device 300. Thus, detailed descriptions of the electronic device in which the antenna module 500 is applied to the wireless power transmission device will be omitted.

According to the coil type unit for wireless power transmission and the manufacturing method thereof in accordance with the present embodiment described above, since the conductive sheet and the conductive hole are included in the magnetic portion and the conductive sheet at this time is formed inside the magnetic portion, it is possible to electrically connect the both ends (inner end and outer end) of the coil pattern inside the magnetic portion through the above configuration.

Therefore, according to the coil type unit for wireless power transmission and the manufacturing method thereof in accordance with the present embodiment, since it is not needed to pass the output wiring coil over the wound coil wiring for the electrical connection between the inner end and the outer end of the coil, it is possible to prevent the overall increase in the thickness of the coil due to the electrical connection between the both ends of the coil.

Therefore, according to the coil type unit for wireless power transmission and the manufacturing method thereof in accordance with the present embodiment, it is possible to achieve slimming by minimizing the thickness of the coil and achieve even slimming of the wireless power transmission device and the electronic device including the coil type unit of the present embodiment.

Further, according to the coil type unit for wireless power transmission and the manufacturing method thereof in accordance with the present embodiment, as described above, since it is not needed to pass the output wiring coil over the wound coil wiring for the electrical connection between the inner end and the outer end of the coil, additional processes of forming additional wiring or performing bonding for the electrical connection between the both ends of the coil are not needed, thus reducing process costs and facilitating manufacture thereof.

As described above, the coil type unit for wireless power transmission and the manufacturing method thereof, the wireless power transmission device, and the electronic device according to the present invention can achieve slimming of the wireless power transmission device and the electronic device including the coil type unit for wireless power transmission as well as the coil type unit for wireless power transmission by electrically connecting the both ends of the coil pattern inside the magnetic portion to minimize the thickness of the coil.

Further, the coil type unit for wireless power transmission and the manufacturing method thereof, the wireless power transmission device, and the electronic device according to the present invention have no need for additional processes such as additional wiring forming and bonding for electrical connection by electrically connecting the both ends of the coil pattern inside the magnetic portion, thus reducing process costs and facilitating manufacture thereof.

Reference in the specification to "an embodiment" of the present principles, as well as other variations thereof, means that a particular feature, structure, characteristic, and so forth described in connection with the embodiment is included in at least one embodiment of the present principles. Thus, the appearances of the phrase "in an embodiment", as well as any other variations, appearing in various places throughout the specification are not necessarily all referring to the same embodiment.

While operations are depicted in the drawings of the present invention, this should not be understood as requiring that such operations be performed in the particular order shown or that all illustrated operations be performed to achieve desirable results. In certain circumstances, multitasking and parallel processing may be advantageous.

In the specification, "at least one of" in the case of "at least one of A and B" is intended to encompass the selection of the first listed option (A) only, or the selection of the second listed option (B) only, or the selection of both options (A and B). As a further example, the case of "at least one of A, B, and C" is intended to encompass the selection of the first listed option (A) only, or the selection of the second listed option (B) only, or the selection of the third listed option (C) only, or the selection of the first and second listed options (A and B) only, or the selection of the second and third listed options (B and C) only, or the selection of all three options (A, B, and C). This can be extended, as readily apparent by those skilled in the related arts, for as many items listed.

So far the preferable embodiments of the present invention have been described. All the embodiments and conditional examples disclosed through the specification are intended to help those skilled in the art to understand the principles and concepts of the present invention, and it will be appreciated by those skilled in the art that the present invention can be implemented in a modified form without departing from the essential characteristics of the present invention. Therefore, the embodiments should be considered in descriptive sense and not for purpose of limitation. The scope of the present invention is defined by the appended claims rather than the foregoing description, and all differences within the scope will be construed as being included in the present invention.

What is claimed is:

1. A coil type unit for wireless power transmission, comprising:

a coil pattern in the form of a wiring pattern;

a magnetic portion having the coil pattern attached to one surface thereof;

a conductive sheet embedded in the magnetic portion; and an adhesive portion interposed between the magnetic portion and the coil pattern to bond the magnetic portion and the coil pattern to each other, wherein the magnetic portion has conductive holes formed in the position at which ends of the coil pattern are disposed, to electrically connect the ends of the coil pattern and the conductive sheet.

2. The coil type unit for wireless power transmission according to claim 1, wherein the conductive sheet is laminated on a part or all of the surface of a sheet layer on which the conductive sheet is to be laminated.

3. The coil type unit for wireless power transmission according to claim 1, wherein the conductive sheet is formed by printing and laminating conductive ink or conductive paste.

4. The coil type unit for wireless power transmission according to claim 1, wherein the magnetic portion uses at least one of a ferrite sheet, a metal sheet, and a hybrid type sheet, which uses a combination of metal and ferrite.

5. The coil type unit for wireless power transmission according to claim 1, wherein the conductive hole is formed by forming a through-hole in the magnetic portion and filling conductive ink or conductive paste in the through-hole.

* * * * *